US005156366A

United States Patent [19]

Anderson

[11] Patent Number: 5,156,366

[45] Date of Patent: Oct. 20, 1992

[54] GOLF BAG STAND

[75] Inventor: Victor R. Anderson, Trumbull, Conn.

[73] Assignee: Loctec Corporation, Monroe, Conn.

[21] Appl. No.: 727,869

[22] Filed: Jul. 10, 1991

[51] Int. Cl.[5] ..... A63B 55/00

[52] U.S. Cl. ..... 248/96; 248/169; 248/171

[58] Field of Search ..... 248/170, 171, 168, 169, 248/409, 96; 280/DIG. 6, 646, 47.18; 206/315.7

[56] References Cited

U.S. PATENT DOCUMENTS

| | | | |
|---|---|---|---|
| 1,176,031 | 3/1916 | Cady | 248/96 X |
| 1,752,114 | 3/1930 | Shaw | 248/96 |
| 2,572,408 | 10/1951 | Hoek | 248/96 X |
| 4,620,682 | 11/1986 | Yim | 280/DIG. 6 |
| 4,676,464 | 6/1987 | Reimers | 206/315.7 X |
| 4,834,235 | 5/1989 | Solheim | 206/315.7 |
| 4,921,192 | 5/1990 | Jones | 248/96 |
| 4,949,844 | 8/1990 | Yang | 206/315.7 |
| 5,036,974 | 8/1991 | Ross, Jr. | 206/315.7 |

OTHER PUBLICATIONS

Ad for "Eclipse" (Sun Mountain Sports).
Ad from Jones Sports Co. "Step-up Bag".
Ad for Voit Grasshopper Golf Bag.

*Primary Examiner*—J. Franklin Foss
*Attorney, Agent, or Firm*—Haynes N. Johnson

[57] ABSTRACT

A golf bag stand having both an actuated state and a disabled state. The bag has two legs pivotally mounted side by side at the top of the bag. Each leg carries a sliding bracket which can be held in a disabled position and an actuating position. The two arms of a V-shaped spring push rod fit within the bracket, the arms being spring-pressed towards one another. The lower end of this rod forms a projector. When the stand is in its disabled state, the projector does not extend beyond the base of the bag; when in its actuated state, the projector extends two to three inches below the base of the bag. When the device is in its actuated state and the user puts the bag down on its base, the projector touches the ground and is forced upwardly relative to the bag. This forces the legs to swing outwardly, forming, with the bag itself, a tripod-like stand for the bag.

9 Claims, 4 Drawing Sheets

GOLF BAG STAND

FIELD OF THE INVENTION

This invention relates to the field of golf bag stands and, in particular, stands which are self-opening when a bag is being put down, self-closing when the bag is picked up, and which can be easily disabled when desired.

BACKGROUND OF THE INVENTION

Various golf bag stands exist with some type of structure that will open and close when the bag is put down or raised. None, however, appear to have a simple disabling feature such that they can be made operative when their function is not wanted.

BRIEF SUMMARY OF THE INVENTION

My invention is a golf bag stand which has both an actuated state, for use when playing golf, and a disabled state, for use when the golf bag is being stored. In use, the stand forms a supporting tripod for the bag when the user puts it down.

The bag has two legs pivotally mounted side by side on the cuff at the top of the bag. Each leg carries a sliding bracket which can be held in two positions: a disabled position near the top of the legs, and an actuating position two to three inches farther down the leg. The two arms of a V-shaped spring push rod fit within the bracket, the arms being spring-pressed towards one another. The lower end of this member forms a projector which slides within a bracket mounted on the cuff at the base of the golf bag. When the stand is in its disabled state, the projector does not extend beyond the base of the bag; when in its actuated state, the projector extends two to three inches below the base of the bag.

When the device is in use, i.e., in its actuated state, and the user puts the bag down on its base, the projector touches the ground and is forced upwardly relative to the bag. This forces the legs to swing outwardly, forming, with the bag itself, a tripod-like stand for the bag. It also causes the legs and arms of the V-shaped push rod to spread apart from each other, acting against the springiness of the member. When the bag is again picked up, the arms tend to come together, causing the legs to retract and the projector to again be extended. The bag can then be carried.

In its disabled state, with the sliding brackets in their upper position, the projecting member does not extend beyond the bottom of the bag. As a result, putting the bag down does not cause the legs to extend.

DETAILED DESCRIPTION OF THE INVENTION

My golf bag stand has two states, actuated and disabled. In the former, when the bag is put down, legs will extend outwardly from the bag forming, with the bag itself, a tripod stand. When the bag is picked up, the legs will retract to a position flush with the bag. When it is disabled, the legs will not extend outwardly when the bag is put down.

Figure 1:
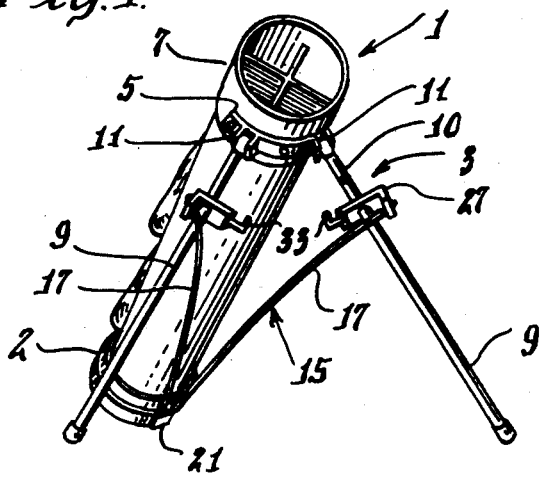
FIG. 1 is a perspective view of my golf bag stand as it would be seen in use supporting a bag.
Figure 3:
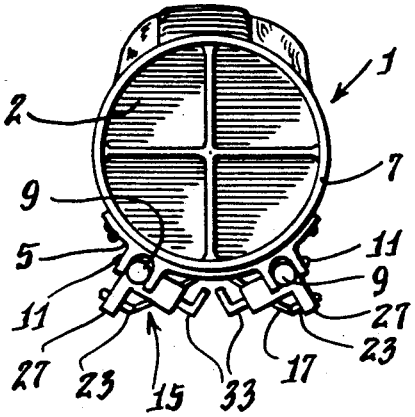
FIG. 3 is a top plan view of the stand, again disabled.

FIG. 1 shows my golf bag 1, with base 2, being supported by my stand 3. The upper end of the stand has a collar 5 which is secured to the cuff 7 on the top of the bag. The legs 9 of the stand are pivotally attached to the collar at pivots 11. A V-shaped spring push rod 15 can push the legs outwardly about the pivots. Since the pivots 11 are on different parts of the periphery of the cuff 7, they have axes which are at an angle to one another, causing the legs to spread as they are pushed outwardly. Legs 9 and base 2, i.e., the bottom projector end of the V-shaped push rod, form a tripod support for the bag.

Push rod 15 is made of steel or spring steel. It has a U-shaped base section 19 (projector) and upwardly extending arms 17, the latter terminating in upper angled ends 23. Springiness in rod 15 causes the two arms 17 and the two ends 23 tend to move towards each other to an extent that, were the push rod 15 not mounted in the stand, the arms and their ends would come together. Projector 19 fits within an opening 22 in a bracket 21 which is secured to the cuff at base 2 of the bag. When the stand is in its disabled state, projector 19 does not extend beyond the base 2; when in actuated state, projector 19 will extend beyond the base by about two to three inches.

Each of legs 9 carries a sliding bracket 27. Each of the brackets 27 has a hole 28 in it to receive and slidingly fit about its respective leg 9. Each bracket also has an opening 29 to receive and hold one of the upper angled ends 23 of the V-shaped member 15. Ends 23 can be held in position in openings 27 with bolts or in any other desired manner. Ends 23 should, however, be able to twist slightly within openings 27.

Brackets 27 each have a recess 31 to receive a pin 33 with a collar 35 about it. Pins 33 have angled outer ends or handles 34 by which they can be grasped. There is a spring 37 about each pin which presses against the collar and so pushes the pin outwardly.

Legs 9 each have two holes in them, an upper disabling hole 10 proximate to the top of the legs, and a slightly lower actuating hole 41. These holes are so positioned and so spaced that they can used in conjunction with bracket pins 33 to keep the stand in disabled state (using holes 10) or in actuating state (using holes 41). Upper hole 10 need not always be used, since, in the disabled state, friction from the spring pressure of push rod 15 may be adequate to hold the sliding brackets 27 in place on legs 9.

The pins 33 are so positioned that they will press into hole 10 or hole 41 when the bracket 27 is slid along leg 9 so that the pins are in alignment with one hole or the other.

Though I have shown a pin and hole structure for holding the sliding brackets 27 in position on legs 9, other structures such as spring-pressed detents could be used. The important thing is that, whether in the upper disabled state or in the lower actuated state, the upper ends of the V-shaped push rod 15 be held against sliding movement relative to legs 9 as long as the stand is in one state or the other.

Figure 2:
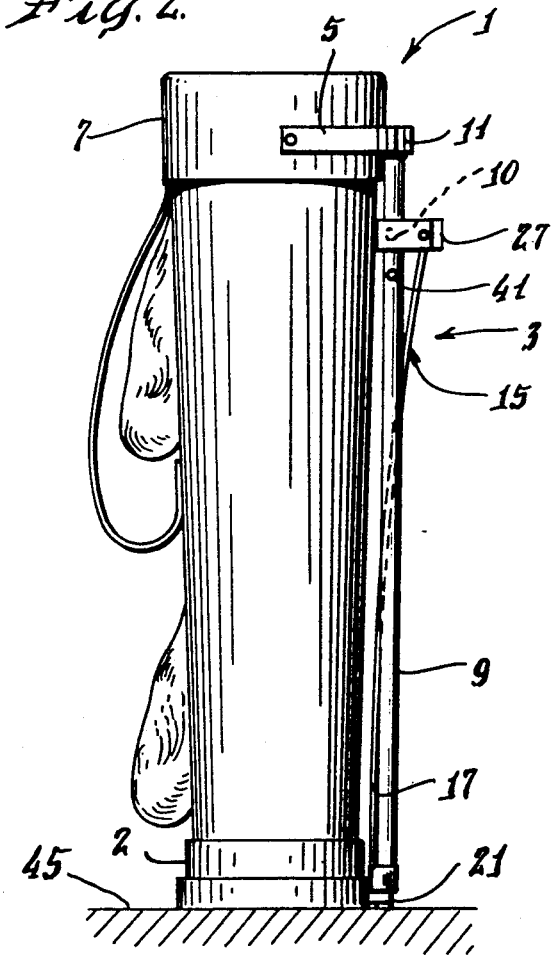
FIG. 2 is a side elevation of the stand when disabled.
Figure 4:
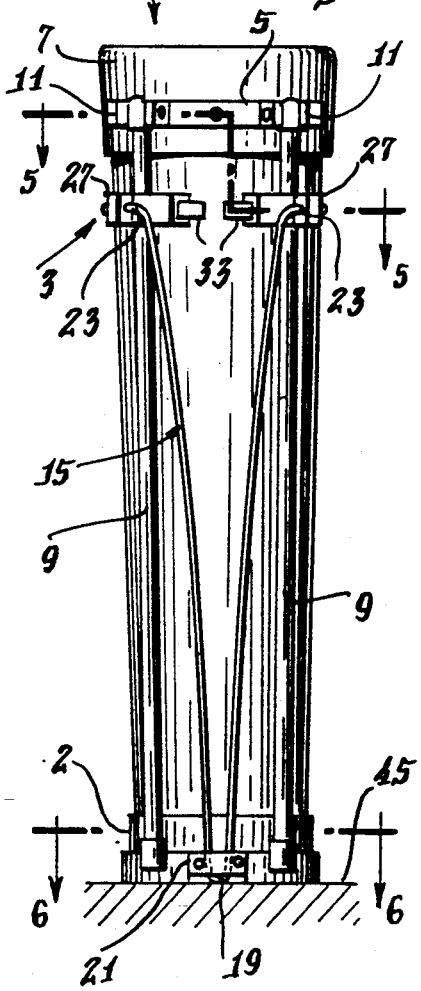
FIG. 4 is a front elevation of the stand, again disabled.
Figure 5:
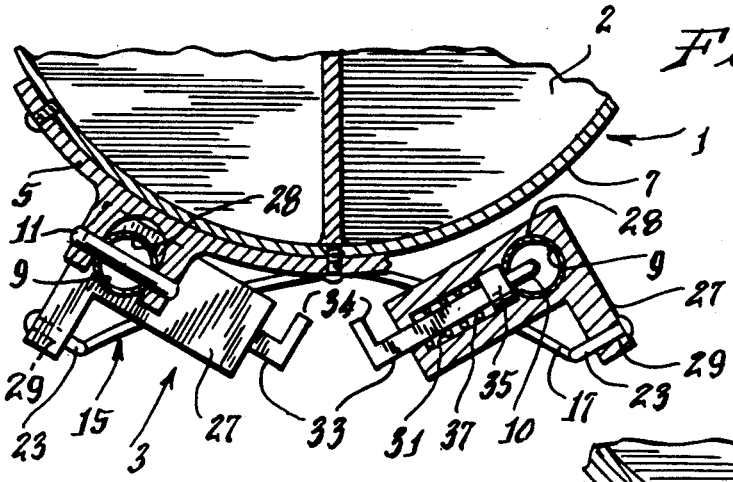
FIG. 5 is a horizontal section, taken on line 5—5 of FIG. 4.
Figure 6:
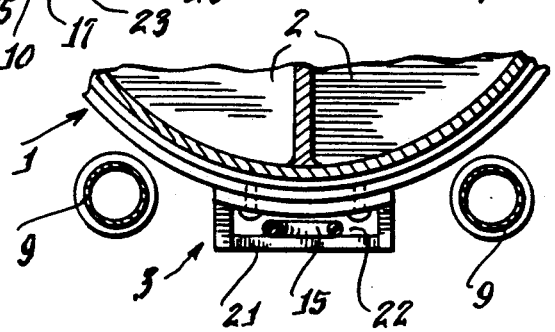
FIG. 6 is a horizontal section, taken on line 6—6 of FIG. 4.

When one is not playing golf, he does not want the stand to operate. Therefore, he disables the bag by taking handles 34 and pulling them towards each other, removing the pins 33 from holes 41 in the legs. This allows brackets 27 to be lifted upwardly along legs 9 until the brackets are opposite upper, disabling holes 10. The pins can then be allowed to press into those holes. The stand will then be collapsed and have the appearance seen in FIGS. 2 and 4, with the lower end of the V-shaped member, projector 19, not projecting beyond base 2. The golf bag can then be stood on its base 2 for storage without actuating the stand.

Figure 8:
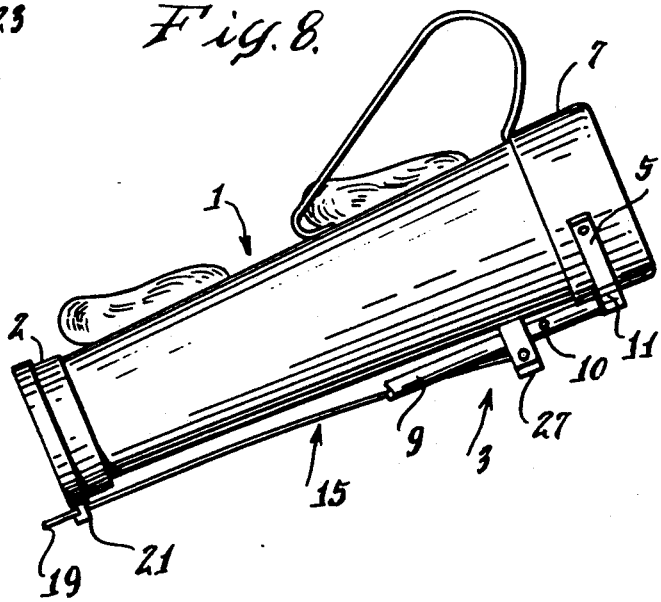
FIG. 8 is a side elevation of the bag, with the stand actuated, but as it would appear (closed) while the bag is being carried.

When one is playing golf, the stand should be in its actuated state. This is down by removing the pins 33 from the disabling holes 10 and sliding the brackets 27 downwardly until the pins fit within actuating holes 41. This causes projector 19 to extend beyond the base of the bag, as seen in FIG. 8.

Figure 7:
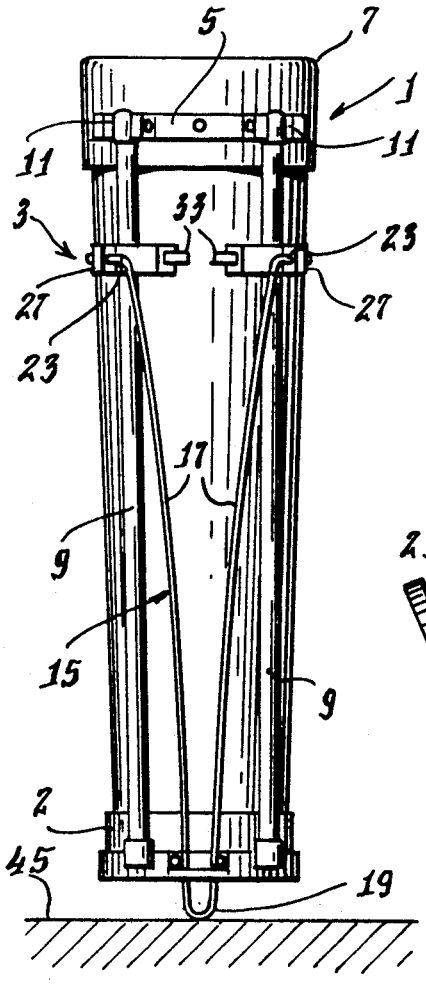
FIG. 7 is a front elevation of the stand, actuated and no longer disabled, and shown as the bag is being placed on the ground. Continuing to lower the bag will cause the stand to open.
Figure 10:
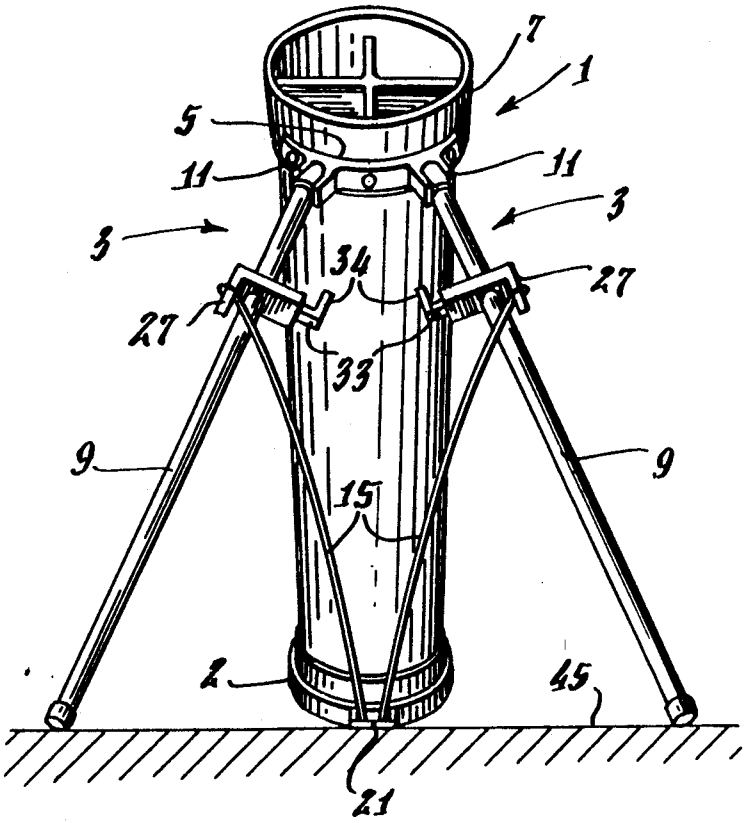
FIG. 10 is a front elevation, again of the stand supporting the bag.
Figure 9:
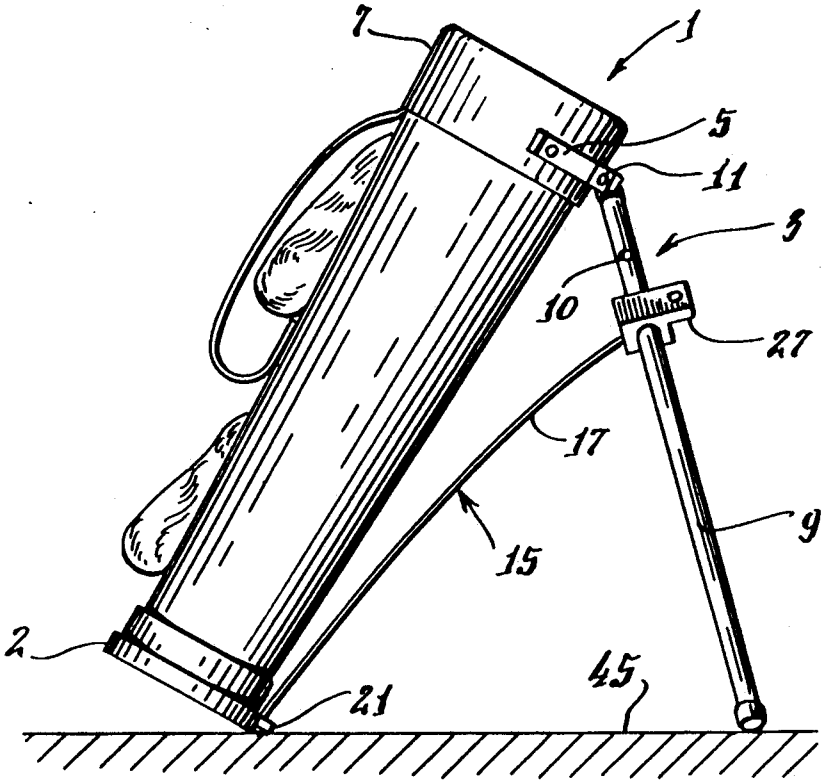
FIG. 9 is a side elevation of the stand supporting the bag. The stand is actuated.
Figure 13:
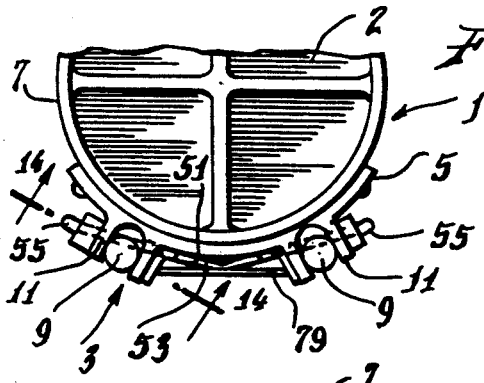
FIG. 13 is a transverse section of the closed modified stand, taken just above the collar.
Figure 14:
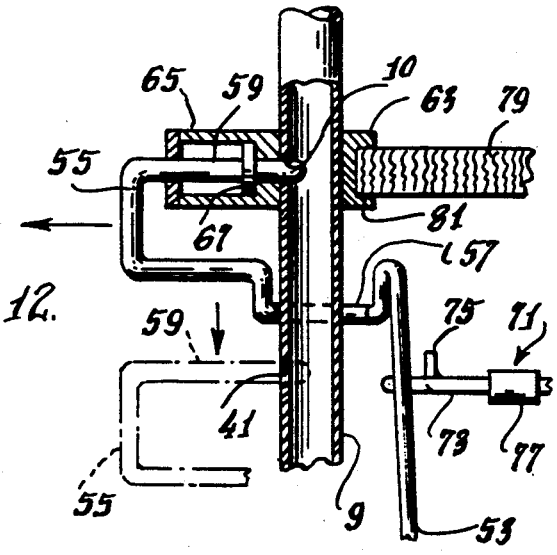
FIG. 14 is a section taken on line 14—14 of FIG. 13.
Figure 12:
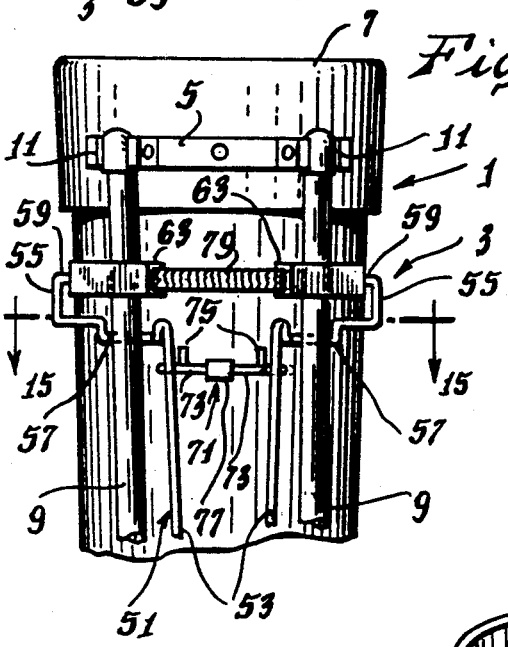
FIG. 12 is an elevation of the upper portion of the modified stand, when the stand is not supporting a golf bag.
Figure 15:
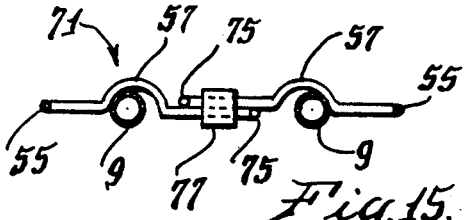
FIG. 15 is a section taken on line 15—15 of FIG. 12.
Figure 11:
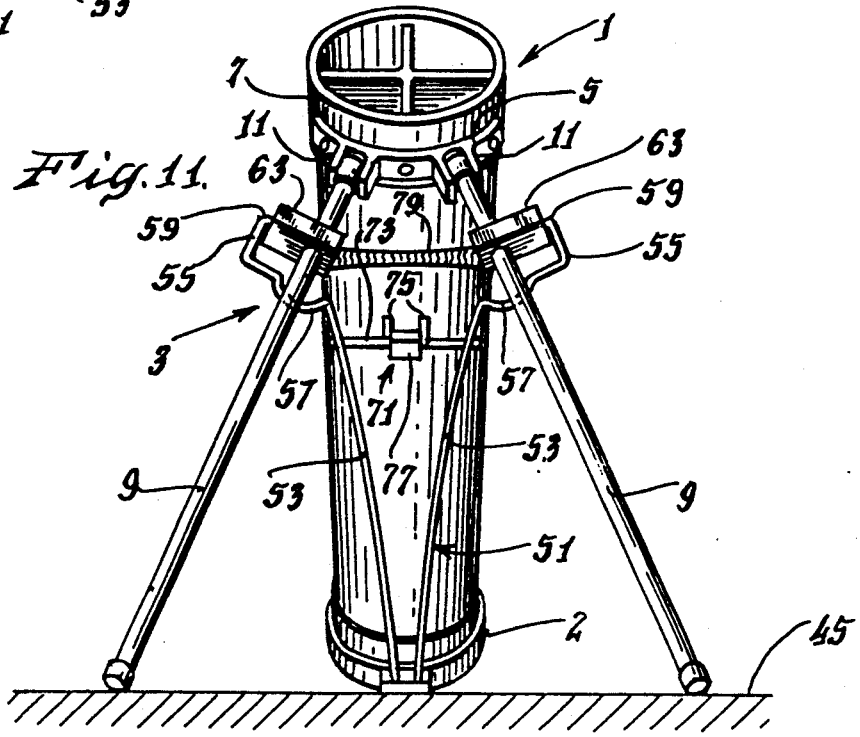
FIG. 11 is a perspective view of a modification of my invention, showing the stand in use supporting a golf bag.

Now, placing the base upon the ground (as is being done in FIG. 7) will cause projector 19 and V-shaped push rod 15 to be pushed upwardly (FIG. 19). Since the member 15, restrained by brackets 27, cannot slide upwardly on legs 9, it forces the legs to pivot outwardly. At the same time, since the angle of the pivots 11 of legs 9 will not permit the two legs to remain parallel, the lower ends of legs 9 spread apart. This results in the bag and the two legs forming a tripod, which makes a stand for the bag (FIGS. 9 and 10). At the same time, the arms 15 are spread apart against their spring-pressed normal condition close to one another.

When the bag is again picked up, there will be nothing pressing projector 19 upwardly. As a result, the spring pressure in arms 17 cause them to press towards each other, driving projector 19 downwardly and, so, collapsing the stand, returning it to the position shown in FIG. 8.

A modification is shown in FIGS. 11 to 15. Here, the operation is similar to the above-described stand. However, the system for engaging and disengaging the sliding brackets with the upper disabling holes 10 and the lower actuating holes 41 in the legs is different.

The modification includes V-shaped spring push rods 51, similar to rods 15, and having upper arms 53. Arms 53, in this instance, have U-shaped extensions 57, bending back upon themselves to end in inwardly pointing pins 59. The extensions 57 are bent so as to pass around legs 9. Pins 59 pass through recesses 65 in sliding brackets 63 to fit within holes 10 and 41 to hold the unit in actuated or disabled position. The pins are guided through recesses 65 by guide rings 67, so that they can readily enter the holes in the legs.

A pin release system 71 is used to release the pins from the holes. It includes two arms 73, one of which is secured to each arm 53 of push rod 51. The arms parallel each other, have upwardly extending extension handles 75, and are slidingly held together by fitting 77. By grasping handles 75 and pulling them towards one another, arms 53 a pressed apart, causing the pins 59 to be removed from one set of holes so they can be placed in the other. An elastic member 79 is secured to openings 81 in brackets 63 to draw the brackets towards one another. This creates a force opposing that caused by squeezing handles 75 together, to assure that the pins are removed from the holes instead of the legs 9 separating from one another. In other respects the modified stand works in the same manner as the stand of the earlier Figures.

Accordingly, I have provided a golf bag stand which can have both actuated and disabled states. The stand can, of course, be made as part of a golf bag or, alternatively, be manufactured separately for later attachment to the bag.

I claim:

1. A stand for a golf bag, said stand having erect and collapsed positions and said stand including a pair of legs, means for pivotally securing said legs to the upper part of said golf bag, a pair of arms coming together at their bottom portion to form a downwardly-pointing projector, means for slidingly holding said projector against the lower part of said golf bag, means for pivotally securing one of said arms to one of said legs and the other of said arms to the other of said legs, said securing occurring at two positions on each of said legs, an upper disabling position and a lower actuating position, said projector extending below its holding means when said arms are secured in the lower actuating position, and spring means associated with said arms causing said stand to be in its collapsed position, whereby, when said arms are secured at said lower actuating position, said projector will project below said bag and upward force thereon will cause said stand to come to its erect position.

2. A stand as set forth in claim 1 in which said spring means comes from inherent springiness in said arms, said arms being spring-pressed towards one another.

3. A stand as set forth in claim 1 in which said means for securing said arms to said legs is a pair of brackets, one slidingly mounted on each leg, said brackets having spring-pressed pins, and said legs each having at least one hole to receive its respective said pin.

4. A stand as set forth in claim 1 in which said bracket securing means include U-shaped extensions on the upper portions of said arms, said portions forming inwardly extending pins, and said pins passing through said brackets to press against said legs.

5. A stand as set forth in claim 1 in which said legs, said arms, said projector, and said upper disabling lower actuating positions are so dimensioned and so positioned relative to one another and to said golf bag that said projector projects below said bag when said stand is in its actuating position and does not so project when said stand is its disabled position.

6. A collapsible supporting stand for a golf bag, said stand having collapsed and erect positions and having actuating and disabling states, said stand including a collar securable to the cuff of said bag proximate to the top thereof, a pair of legs pivotally secured to said collar side by side, a base member securable at the base of said bag, a slidable bracket on each said leg, means for securing each said bracket in one or the other of two positions on its respective said leg proximate to the top of the leg, said positions being an upper disabling position and a lower actuating position, said bracket securing means including a spring-pressed pin in at least one of said brackets and a hole in the respective said leg to receive said pin, a V-shaped push rod having upwardly-extending arms and a projector, the upper ends of said arms being pivotally secured to said brackets, one to each said bracket, and said projector pointing downwardly and slidingly fitting within said base member, and said V-shaped push rod being dimensioned such that, with said stand collapsed, said projector extends beyond the bottom of said bag when said bracket is in said actuating position and does not extend beyond the bottom of said bag when said bracket is in said disabling position, wherein upward force on said projector, when said bracket is in its actuating state, will erect said stand, and said stand can be made actuable or can be disabled.

7. A collapsible supporting stand for a golf bag, said stand having collapsed and erect positions and having actuating and disabling states, said stand including a collar securable to the cuff of said bag proximate to the top thereof, a pair of legs pivotally secured to said collar side by side, a base member securable at the base of said bag, a slidable bracket on each of said leg, means for securing each said bracket in one or the other of said two positions on its respective said leg proximate to the top of the leg, said positions being an upper disabling position and a lower actuating position, said bracket securing means including U-shaped extensions on the upper portions of said arms, said portions forming inwardly extending pins, and said pins passing through said brackets to press against said legs, a V-shaped push rod having upwardly-extending arms and a projector, the upper ends of said arms being pivotally secured to said brackets, one to each said bracket, and said projector pointing downwardly and slidingly fitting within said base member, and said V-shaped push rod being dimensioned such that, with said stand collapsed, said projector extends beyond the bottom of said bag when said bracket is in said actuating position and does not extend beyond the bottom of said bag when said bracket is in said disabling position, whereby upward force on said projector, when said bracket is in its actuating state, will erect said stand, and said stand can be made actuable or can be disabled.

8. A collapsible stand as set forth in claim 7 including a pin release system, said system including release arms associated with said upwardly-extending arms to draw the latter towards one another and thereby to release said pins, and elastic means drawing said slidable brackets towards one another.

9. A collapsible supporting stand for a golf bag, said stand having collapsed and erect positions and having actuating and disabling states, said stand including a collar securable to the cuff of said bag proximate to the top thereof, a pair of legs pivotally secured to said collar side by side, a base member securable at the base of said bag, a slidable bracket on each said leg, means for securing each said bracket in one or the other of two positions on its respective said leg proximate to the top of the leg, said positions being an upper disabling position and a lower actuating position, a V-shaped push rod having upwardly-extending arms and a projector, the upper ends of said arms being pivotally secured to said brackets, one to each said bracket, and said projector pointing downwardly and slidingly fitting within said base member, said arms being spring-pressed towards one another, whereby, upon removal of force from said projector, said stand will be caused to collapse, and said V-shaped push rod being dimensioned such that, with said stand collapsed, said projector extends beyond the bottom of said bag when said bracket is in said actuating position and does not extend beyond the bottom of said bag when said bracket is in said disabling position, whereby upward force on said projector, when said bracket is in its actuating state, will erect said stand, and said stand can be made actuable or can be disabled.

* * * * *